US006499802B2

(12) United States Patent
Drira

(10) Patent No.: US 6,499,802 B2
(45) Date of Patent: Dec. 31, 2002

(54) ARTICULATED SEAT

(75) Inventor: Fathi Drira, Brossard (CA)

(73) Assignee: Art Design International Inc., Saint-Hubert (CA)

( * ) Notice: Subject to any disclaimer, the term of this patent is extended or adjusted under 35 U.S.C. 154(b) by 0 days.

(21) Appl. No.: 09/820,239

(22) Filed: Mar. 28, 2001

(65) Prior Publication Data

US 2001/0038234 A1 Nov. 8, 2001

Related U.S. Application Data

(60) Provisional application No. 60/204,616, filed on May 16, 2000.

(51) Int. Cl.[7] ..... A47C 3/025

(52) U.S. Cl. ..... 297/284.11; 297/284.1; 297/313

(58) Field of Search ..... 297/284.1, 284.11

(56) References Cited

U.S. PATENT DOCUMENTS 1,836,630 A * 12/1931 Thum ..... 297/302.4
4,018,477 A * 4/1977 Hogan ..... 297/284.11
4,491,365 A * 1/1985 Murakami ..... 297/284.11
4,498,702 A * 2/1985 Raftery ..... 297/312
4,636,002 A * 1/1987 Genjiro ..... 297/319
5,009,466 A * 4/1991 Perry ..... 297/323
5,380,063 A * 1/1995 Dauphin ..... 297/284.11
5,716,099 A * 2/1998 McDiarmid ..... 297/302.1
6,068,335 A * 5/2000 Glover ..... 297/256.15

* cited by examiner

*Primary Examiner*—Peter R. Brown
*Assistant Examiner*—Joseph Edell
(74) *Attorney, Agent, or Firm*—Eric Fincham

(57) ABSTRACT

A seat structure for a chair which has a frame with a front frame section and a rear frame section, the front frame section and rear frame section being joined by an articulation joint such that the front frame section may be articulately moved with respect to the rear frame section. There are provided stopper means to limit the degree of articulation of the front frame section. There is also provided means for connecting the front and rear frame sections together.

7 Claims, 4 Drawing Sheets

ARTICULATED SEAT

The present application claims priority on U.S. Provisional Application Ser. No. 60/204,616 filed May 16, 2000.

The present invention relates to a seat structure for a chair or the like and more particularly, relates to a seat structure for a chair wherein the seat structure has a articulated portion.

BACKGROUND OF THE INVENTION

Today, seats for people typically have a seat portion and a back portion which may or may not be adjustable relative to each other. Normally, both the seat portion and the back portion are rigid. As such, they do not provide any capability for movement or adjustment to a person's body and/or seating position including the leg position. It will be understood that compatibility between a person's body and the seat along with an ability to move therein are essential for comfort.

There have been various proposals in the art for seats with various degrees of adjustment. Thus, there are disclosed seats which have adjustable backs relative to the seat portion and as well, some of the seats have lumbar supports.

A particular type of chair having a seat portion is shown in U.S. Pat. No. 5,393,126 which teaches a composite support frame structure for the construction of a seat. The support structure comprises a rigid continuous rod like frame formed in a closed loop and which has opposed diverging rod like side members which lie in a common plane. While such a seat has received a wide degree of acceptance, it does not have any means for articulation.

Naturally, it would be desirable to provide an office type chair which has a maximum degree of comfort and adjustability since the user must occupy the chair for relatively long periods of time and the user must also be able to concentrate on their work without being distracted by uncomfortable seating. One desirable adjustment for a chair is the incorporation of a flexible area in the seat front edge upon which the user's thighs rest. This can be particularly desirable in chairs having a tilting seat so that as the user leans back in the chair thereby tilting the seat, the leading edge of the seat is depressed downwardly to allow the user's feet to remain on the floor.

While it has been recognized that such an adjustment is desirable and indeed there have been proposals for structures which allow the front portion of the seat to be articulated with respect to the rear portion, many of these devices require manual adjustment.

Also, many of the prior art mechanisms are costly to manufacture and assemble and incorporate complicated adjustment devices which are difficult to conceal internally to the seating unit. It is also being proposed to use foam, which is flexible, to achieve an articulation of the seat. One problem which foam presents is the breaking down of the same. Also, stretching of the fabric can present a problem. With the increased emphasis upon the visual appeal of office furniture, it is highly desirable that the controls be maintained internally to the seating unit itself.

SUMMARY OF THE INVENTION

It is an object of the present invention to provide a seat having an articulation capability.

According to one aspect of the present invention, there is provided a seat structure for a chair, the seat structure comprising a frame having a front frame section and a rear frame section, the rear frame section having a generally U shaped configuration with a rear transverse frame member and first and second rear frame side members, the front frame section having a front transverse frame member and first and second front frame side members, the first rear frame side member and the first front frame side member being joined by a first articulation means, the second rear frame side member and the second front frame side member being joined by a second articulation means, and the first and second articulation means permitting articulation of the front frame section with respect to the rear frame section, at least one of the first and second articulation means having stopper means to limit the degree of articulation of the front frame section.

In a further aspect of the invention, there is provided for an improved chair having a back, a seat, and a support structure for the seat, the improvement comprising a frame having a front frame section and a rear frame section, the rear frame section having a generally U shaped configuration with a rear transverse frame member and first and second rear frame side members, the front frame section having a front transverse frame member and first and second front frame side members, the first rear frame side member and the first front frame side member being joined by a first articulation means, the second rear frame side member and the second front frame side member being joined by a second articulation means, and the first and second articulation means permitting articulation of the front frame section with respect to the rear frame section, at least one of the first and second articulation means having stopper means to limit the degree of articulation of the front frame section.

The articulated seat of the present invention is designed for use with the type of structure shown in U.S. Pat. No. 5,393,126, the teachings of which are hereby incorporated by reference. In other words, the seat structure of the present invention is one wherein tubular elements are used for the frame of the seat structure.

The placement of the articulation means may vary although generally, it is preferred that the articulation means be between 125 mm to 175 mm from the front edge of the chair. Such a spacing has been found to provide the greatest degree of comfort.

It will be understood that the present invention may be used with different types of seats including a monocoque type frame structure and/or a structure wherein separate seats and back portions are provided.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
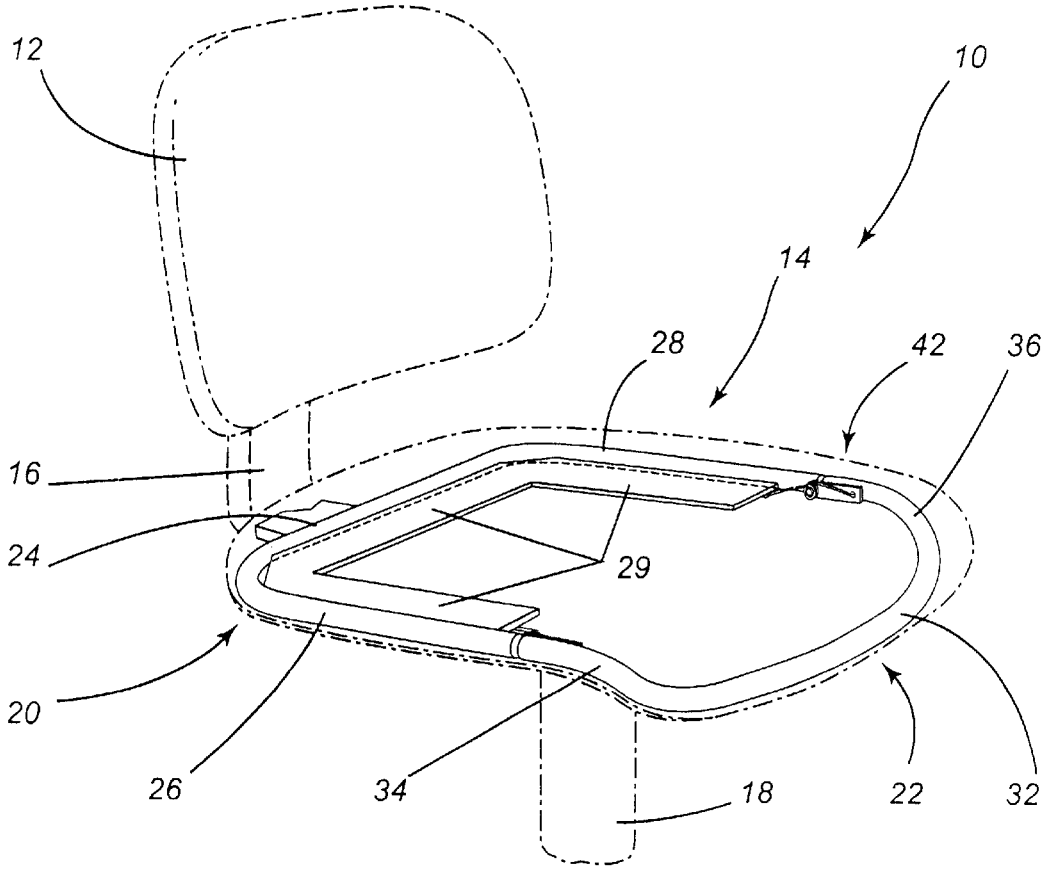
FIG. 1 is a perspective view of a portion of a chair, partially in cutaway, incorporating the articulated portion of the present invention.
Figure 2:
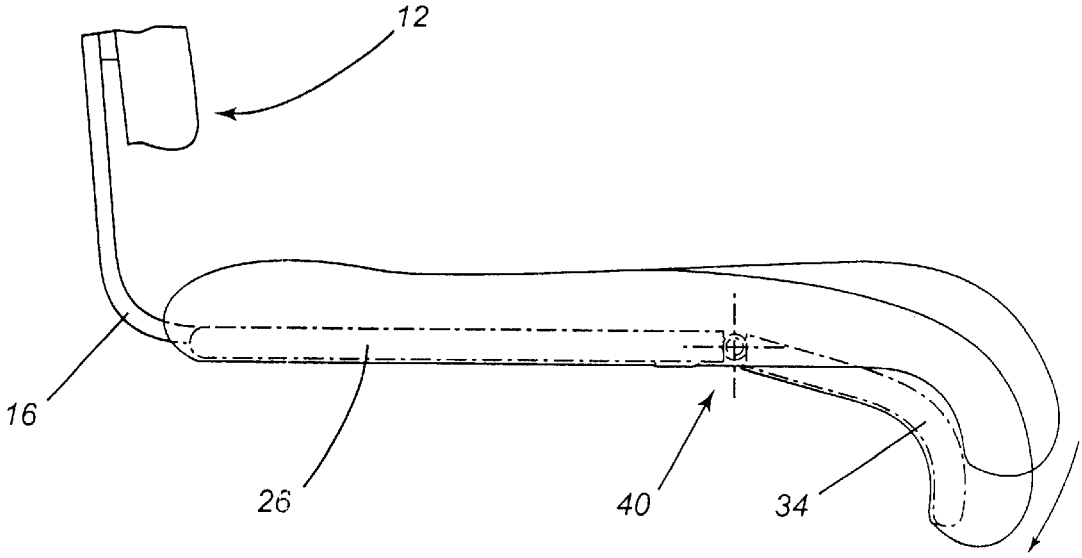
FIG. 2 is a side elevational view thereof.
Figure 3:
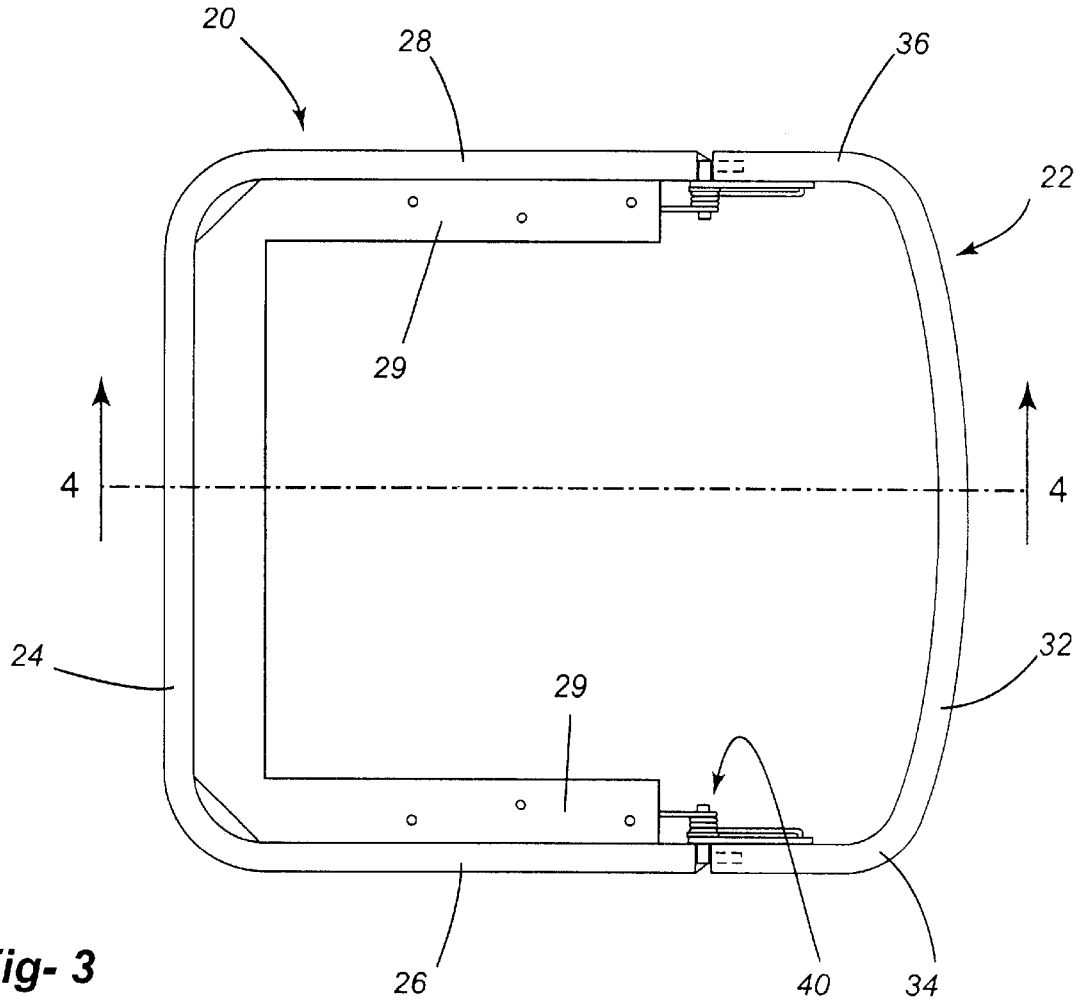
FIG. 3 is a top plan view of the seat portion.
Figure 4:
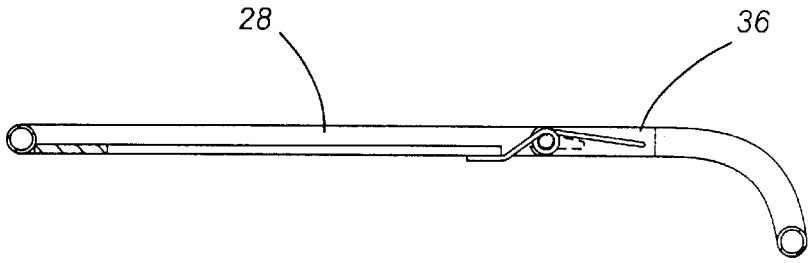
FIG. 4 is a sectional view taken along the lines 4—4 of FIG. 3.

Referring to the drawings in greater detail and by reference characters thereto, there is illustrated in FIG. 1 a chair which is generally designated by reference numeral 10. Chair 10 includes a back rest portion generally designated by reference numeral 12 and a seat portion generally designated by reference numeral 14. Interconnecting back rest portion 12 and seat portion 14 is a connecting portion 16. In this respect, it will be understood, that back rest portion 12 and connecting portion 16 are shown as one embodiment of the invention and that any conventional arrangement may be used including one wherein the back rest portion 12 and seat portion 14 are of a monocoque construction—i.e. a one piece structure. Alternatively, any suitable type of connecting structure between the back rest portion 12 and seat portion 14 may be utilized.

A post 18 is used to support seat portion 14 in a conventional fashion and which is in turn connected to a lower structure (not shown).

Seat portion 14 includes a rear frame generally designated by reference numeral 20 and a front frame generally designated by reference numeral 22. Rear frame 20 includes a rear end frame member 24, a rear first side frame member 26 and a rear second side frame member 28. Connect to the inner side of each of frame members 24, 26 and 28 are seat supports 29.

Front frame 22 includes a front end frame member 32, and a front first side frame member 34 and a front second side frame member 36. Preferably, frame members 24, 26, 28, 32, 34 and 36 are all of a tubular metallic material although other structures could be employed.

Interconnecting rear first side frame member 26 and front first side frame member 34 is a first articulation joint 40 while there is likewise provided a second articulation joint 42 between rear second side frame member 28 and front second side frame member 36. As both articulation joints 40 and 42 are mirror images of each other, only one will be described herein.

Figure 5:
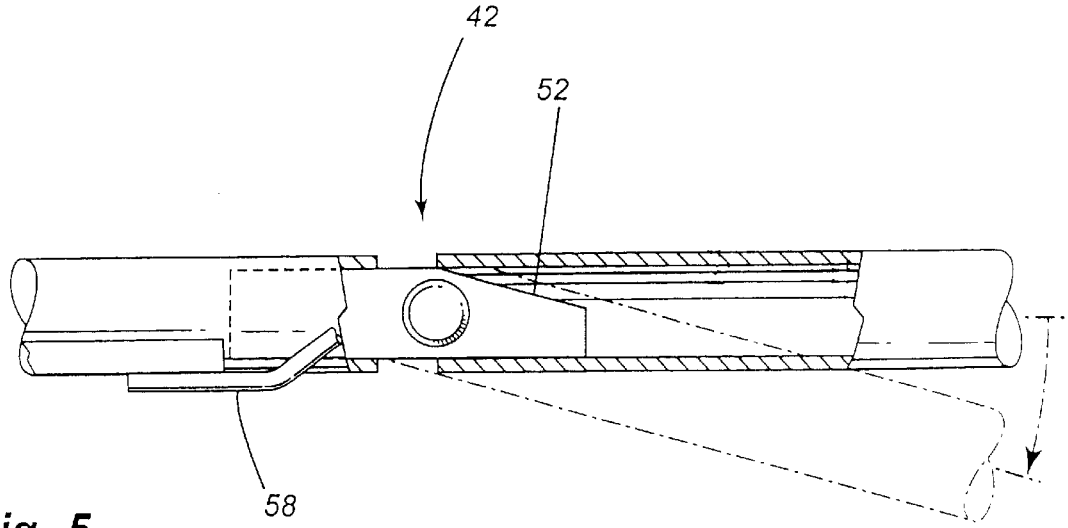
FIG. 5 is a detailed view illustrating the spring member and articulation movement in the seat.
Figure 6:
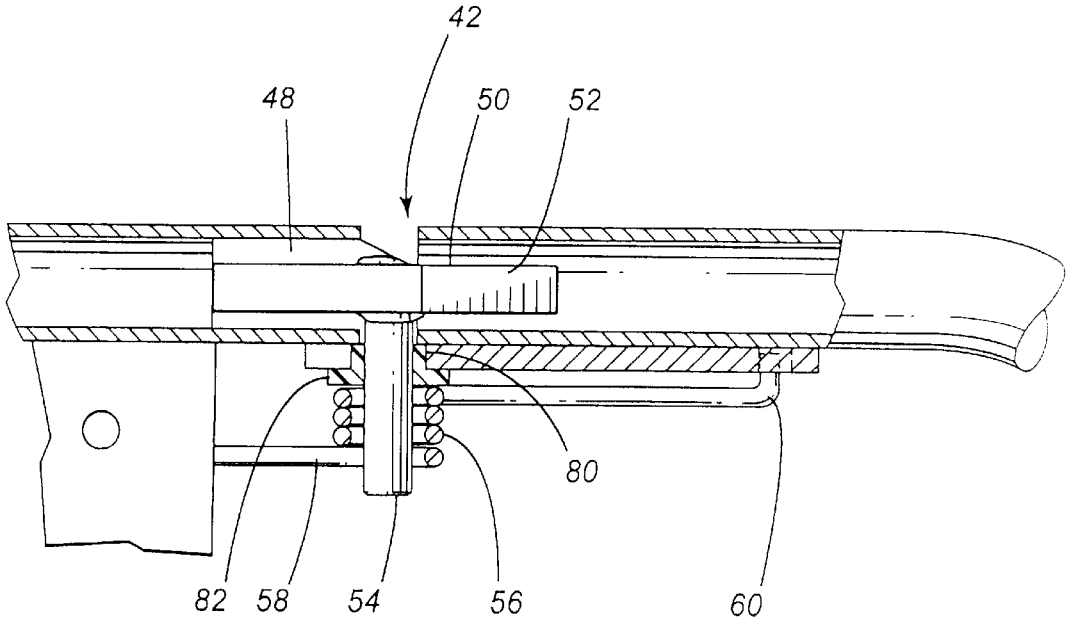
FIG. 6 is a top view of the spring and articulated portion shown in FIG. 5.
Figure 7:
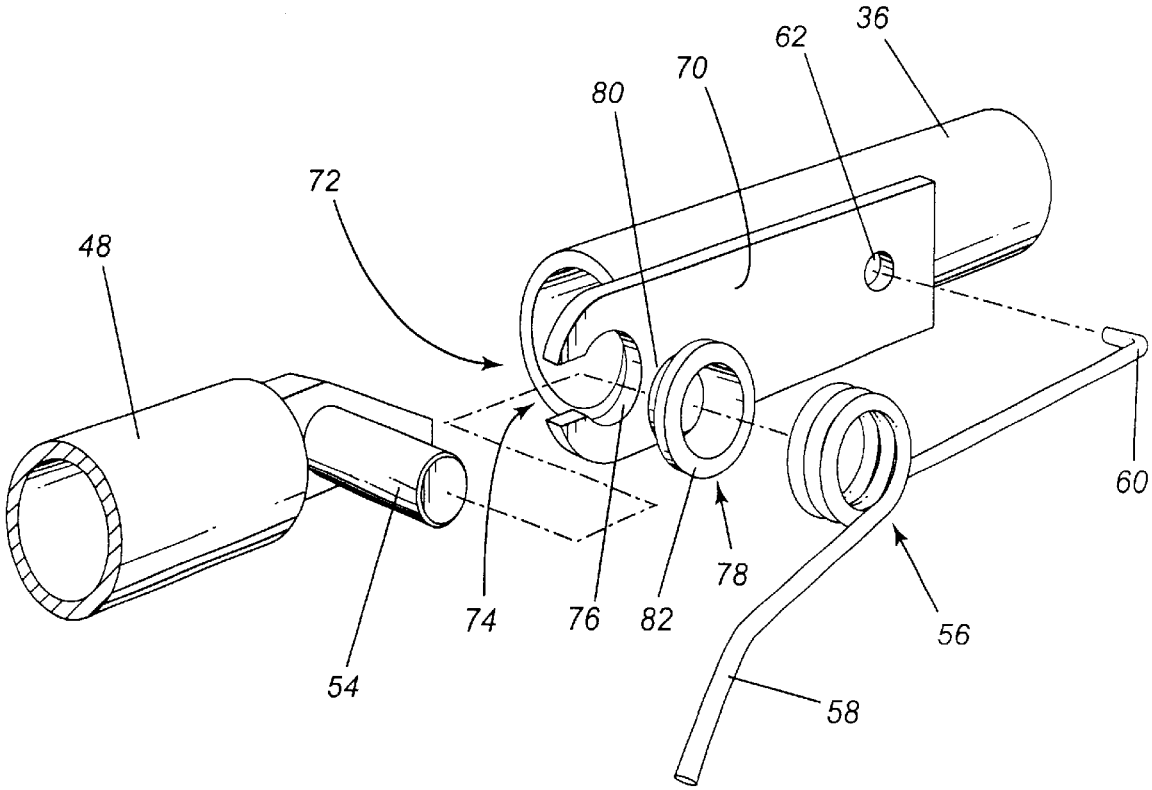
FIG. 7 is an exploded view illustrating the articulation joint.

Articulation joint 42 is best illustrated in FIGS. 5 to 7 and reference will now be made thereto. Articulation joint 42 includes a T-shaped member which has a first end 48 which is inserted into the interior of rear second side frame member 28. A second end 50 of T-shaped member 46 has an upper sloped surface 52 and is inserted in front second side frame member 36. A pin portion 54 extends outwardly between ends 48 and 50.

In assembly, first end 48 is secured to rear second side frame member 28 by suitable means such as welding. In turn, a connecting plate 70 is secured to the inner wall of front first side frame member 36. Connecting plate 70 has, at one end thereof, a keyhole aperture 72 which is comprised of a slot 74 and a circular portion 76. Slot 76 is sized such that pin portion 54 may pass therethrough to circular portion 76.

A retaining ring 78 has a cylindrical portion 80 with an outwardly extending flange 82. Cylindrical portion 80 is sized to fit on pin portion 54. The arrangement is such that cylindrical portion 80 of retaining ring 78 will fit over pin portion 54 and into circular portion 76 of keyhole aperture 72 to thereby retain the frame members 28 and 36 together.

A coil spring 56 is provided to provide the biasing force in the articulation joint 42. Thus, as may be seen, a first end 58 of coil spring rests against seat support 29 while a second end 60 is inserted into an aperture 62 formed in connecting plate 70.

As may be seen in FIG. 5, the arrangement is such that articulation is provided or in other words, front frame 22 is moveable downwardly about articulation joints 40 and 42 when a pressure is exerted thereon against the biasing force of coil spring 56. The degree of movement may be limited by contact of the interior surface of front second side frame member 36 against sloped surface 52 which acts as a stop to limit the movement of front frame 22.

The arrangement is such that easy assembly is provided as described above. Retaining ring 78 functions to maintain the two pieces connected. The biasing force of coil spring 56 ensures that retaining ring 78 remains in position.

It will be understood that the above described embodiment is for purposes of illustration only and that changes and modifications may be made thereto without departing from the spirit and scope of the invention.

I claim:

1. A seat structure for a chair, said seat structure comprising:

a tubular frame having a tubular front frame section and a tubular rear frame section;

said tubular rear frame section having a generally U shaped configuration with a rear transverse frame member and first and second rear frame side members;

said tubular front frame section having a front transverse frame member and first and second front frame side members;

said first rear frame side member and said first front frame side member being joined by a first articulation means;

said second rear frame side member and said second front frame side member being joined by a second articulation means; and said first and second articulation means permitting articulation of said tubular front frame section with respect to said tubular rear frame section, at least one of said first and second articulation means having a stopper to limit the degree of articulation of said tubular front frame section, each of said first and second articulation means comprising a member inserted inwardly into respective rear frame side members and front frame side members, a shaft extending outwardly from said member, a coil spring mounted on said shaft, a first end of said coil spring being connected to a respective front frame member and a second end of said coil spring being connected to a respective rear frame side member.

2. The seat structure of claim 1 wherein both said first and second articulation means each include a respective stopper to limit the degree of articulation of said tubular front frame section.

3. The seat structure of claim 1 wherein each of said shafts of said articulation means extend inwardly towards each other.

4. The seat structure of claim 3 further including a cover member enveloping said front frame section and said rear frame section.

5. The seat structure of claim 1 further including a connecting plate secured each of said first and second front frame side members, each of said connecting plates having a keyhole aperture formed at one end thereof, and a retaining ring mounted on each of said shafts, said retaining rings being sized to fit within said keyhole aperture.

6. In a chair having a back, a seat, and a support structure for said seat, the improvement wherein said seat comprises:

a tubular frame having a tubular front frame section and a tubular rear frame section;

said tubular rear frame section having a generally U shaped configuration with a rear transverse frame member and first and second rear frame side members;

said tubular front frame section having a front transverse frame member and first and second front frame side members;

said first rear frame side member and said first front frame side member being joined by a first articulation means;

said second rear frame side member and said second front frame side member being joined by a second articulation means; and said first and second articulation means permitting articulation of said tubular front frame section with respect to said tubular rear frame section, at least one of said first and second articulation means having a stopper to limit the degree of articulation of said front frame section, each of said first and second articulation means comprising a member inserted inwardly into respective rear frame side members and front frame side members, a shaft extending outwardly from said member, a coil spring mounted on said shaft, a first end of said coil spring being connected to a respective front frame member and a second end of said coil spring being connected to a respective rear frame side member.

7. The chair of claim 6 wherein said first and second articulation means each include a respective stopper to limit the degree of articulation of said tubular front frame section.

* * * * *